United States Patent [19]

Landa et al.

[11] Patent Number: 4,629,308

[45] Date of Patent: Dec. 16, 1986

[54] LENS AND SHUTTER POSITIONING MECHANISM FOR VARIABLE-MAGNIFICATION COPIER

[75] Inventors: Benzion Landa, Edmonton, Canada; Aron Shmaiser, Rishon-Le-zion, Israel; Peter Feher, Johnson City, N.Y.

[73] Assignee: Savin Corporation, Stamford, Conn.

[21] Appl. No.: 628,233

[22] Filed: Jul. 6, 1984

[51] Int. Cl.[4] ..... G03G 15/04

[52] U.S. Cl. ..... 355/3 R; 355/55; 355/71

[58] Field of Search ..... 355/71, 55–57, 355/60, 3 R

[56] References Cited

U.S. PATENT DOCUMENTS 4,125,323 11/1978 Ikeda et al. ..... 355/8

4,279,497 7/1981 Satomi ..... 355/71 X

*Primary Examiner*—R. L. Moses

*Attorney, Agent, or Firm*—Shenier & O'Connor

[57] ABSTRACT

Apparatus for repositioning the lens of a variable-magnification electrophotographic copier to change the image-side path length for a different magnification ratio and for concomitantly adjusting the shutter to compensate for the changed image-side path length. Actuation of a stepper motor rotates a pulley to tension a cable coupled to the lens, pulling the lens to the desired position of a linear track. A portion of the cable extends around a pulley having an axially projecting circumferentially extending ramp on one face. A follower engaging the ramp is coupled to slit-forming members adjacent to the photoconductor so that movement of the cable to reposition the lens produces a concomitant adjustment of the width of the slit to equalize exposure of the photoconductor over a substantially continous range of selected magnifications.

10 Claims, 5 Drawing Figures

LENS AND SHUTTER POSITIONING MECHANISM FOR VARIABLE-MAGNIFICATION COPIER

FIELD OF THE INVENTION

Our invention relates to apparatus for repositioning a lens or other optical element of a variable-magnification optical system, such as that of an electrophotographic copier, to alter the optical path length for operation at a different reproduction ratio and for concomitantly adjusting the exposure to compensate for the altered optical path length.

BACKGROUND OF THE INVENTION

Electrophotographic copiers capable of variable magnification are well known in the art. Generally, the optical system of such a copier includes a lens for forming a focused image of at least a strip portion of an original document on the photoconductor. An electrostatic latent image corresponding to that of the original is formed on the photoconductor, which has been previously uniformly electrically charged, by moving the photoconductor at a uniform velocity through an exposure station while simultaneously effecting relative movement between the optical system and the original document. This relative movement may be accomplished either by moving the document past an optical system consisting of fixed elements or by using one or more movable mirrors to scan a stationary original. To change the reproduction ratio of such an optical system one must alter both the object distance between the lens and the original document and the image distance between the lens and the photoconductor. Generally, this is accomplished by moving either the lens or an image-side mirror to alter the image distance while concomitantly moving an object-side mirror to alter the object distance.

One of the problems inherent in variable-magnification copiers of the prior art is that of maintaining the exposure of the photoconductor surface constant for various selected magnifications. In general, for a constant document illumination the brightness of the optical image on the photoconductor varies inversely with the square of the image distance between the lens and the photoconductor. This distance in turn varies with the selected magnification. Previous systems have compensated for this variation in brightness of the optical image by varying the width of a transversely extending optical slit, adjacent to the photoconductor, in accordance with the selected magnification. Ikeda et al U.S. Pat. No. 4,125,323 discloses one such system in which an eccentric cam coupled to a lens-positioning motor engages a follower coupled to a shutter member adjacent to the photoconductor. While this system does provide some exposure correction for variations in brightness due to changes in image distance, the particular system disclosed is relatively complicated mechanically. In addition, the contour of the cam is such that the actual compensation can equal the required compensation at only a limited number of magnifications. While this may be adequate in a system such as the one disclosed, in which only two reproduction ratios are contemplated, it would fail to provide accurate exposure correction in a system in which the lens position is continuously adjustable to provide continuously variable magnification. Any discrepancy between the actual exposure correction and the desired correction would be particularly evident in a system in which the selected magnification varies between widely spaced limits, such as between 0.5 and 1.5.

SUMMARY OF THE INVENTION

In general, our invention contemplates a lens and shutter positioning mechanism for a variable-magnification copier in which a lens mounted for movement on a linear track is coupled by means of a cable to the pulley of a stepper motor which is actuated to move the lens to the desired position along the track. A portion of the cable extends around a pulley having an axially projecting circumferentially extending ramp on one face thereof. A follower engaging the ramp is coupled to slit-forming members adjacent to the photoconductor so that movement of the cable to reposition the lens produces a concomitant adjustment of the width of the slit to equalize exposure of the photoconductor over a substantially continuous range of selected magnifications.

OBJECTS OF THE INVENTION

One object of our invention is to provide apparatus for positioning the lens and shutter of a scanning system that provides accurate exposure compensation for variations in image brightness over a wide range of selected magnifications.

Another object of our invention is to provide a system for positioning the lens and shutter of an optical scanning system that is mechanically simple.

Other and further objects of our invention will be apparent from the following description.

BRIEF DESCRIPTION OF THE DRAWINGS

In the accompanying drawings, which form part of the instant specification and which are to be read in conjunction therewith, and in which like reference numerals are used to indicate like parts in the various views.

DESCRIPTION OF THE PREFERRED EMBODIMENT

Figure 1:
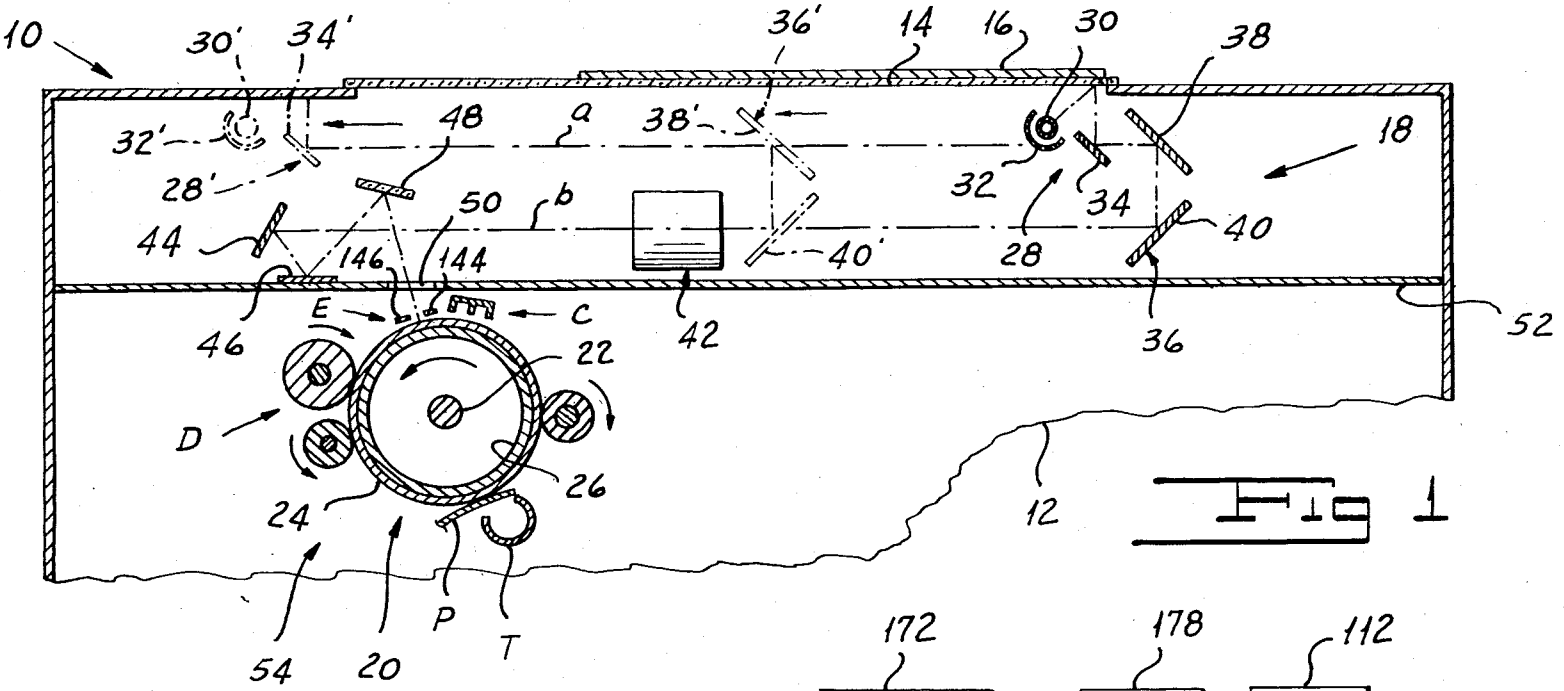
FIG. 1 is a fragmentary section of an electrophotographic copier incorporating our lens and shutter positioning mechanism.

Referring now to FIG. 1, a copier indicated generally by the reference numeral 10 incorporating our lens and shutter positioning mechanism includes a housing 12, the upper wall of which supports a transparent exposure platen 14 for receiving an original document 16. Copier 10 includes an electrophotographic imaging drum, indicated generally by the reference numeral 20, mounted on a shaft 22 for rotation therewith and having a photoconductor 24 supported by a conductive substrate 26.

Drum 20 is driven at a substantially uniform velocity in a manner to be described.

In a manner well known in the art, the drum photoconductor 24 is rotated first past a charging station C at which the surface of the photoconductor receives a uniform electrostatic charge, then past an exposure station E at which the electrostatically charged surface is exposed to an optical image of the document 16 on the platen 14 to form an electrostatic latent image, then past a developing station D at which a liquid developer containing charged toner particles is applied to the latent-image-bearing surface to form a developed toner image, and finally to a transfer station T at which the developed toner image is transferred from the photoconductor 24 to a carrier sheet P.

The optical scanning system of the copier 10, indicated generally by the reference numeral 18, includes a first, or full-rate, scanning carriage indicated generally by the reference numeral 28. Full-rate carriage 28 supports an elongated exposure lamp 30, an elliptical reflector 32 which focuses light from the lamp 30 onto a transversely extending linear strip of the document 16, and a mirror 34 arranged to receive light reflected from the illuminated portion of the document 16.

A second, or half-rate, scanning carriage indicated generally by the reference numeral 36 supports an upper mirror 38 and a lower mirror 40. Mirror 34 of the full-rate carriage 28 reflects light from the document 16 to upper mirror 38 of half-rate carriage 36 along a path segment a parallel to the imaging platen 14. Mirror 38 in turn reflects the light downwardly onto lower mirror 40, which reflects the light along the optical axis b of a lens, indicated generally by the reference numeral 42, which is parallel to platen 14 and path segment a. A stationary mirror 44 disposed on the other side of lens 42 from mirror 40 reflects the light downwardly onto an upwardly facing stationary mirror 46. Mirror 46 abuts a horizontally extending partition 52 isolating the scanning system 18 from the processing portion 54 of the copier 10 disposed therebelow. A downwardly facing mirror 48 reflects light from mirror 46 through a transversely extending slot 50 in partition 52 onto the portion of the photoconductor 24 passing through the exposure station E. Respective slit-forming members 144 and 146, to be described below, adjacent to the drum 20 in the exposure station E, regulate the exposure of the photoconductor 24 to the optical image of the original 16.

In the case of a one-to-one reproduction ratio, the drum 20 is rotated counterclockwise as viewed in FIG. 1 at a predetermined surface speed while full-rate scanning carriage 28 is simultaneously moved at the same speed from the position shown in solid lines in FIG. 1 to a displaced position such as the position 28′ shown in phantom lines in the same figure to scan a document 16 placed on platen 14. Simultaneously with the movement of drum 20 and full-rate carriage 28, half-rate carriage 36 is moved in the same direction as full-rate carriage 28, but at half the speed, between the position shown in solid lines in FIG. 1 and the position 36′ shown in phantom lines in the same figure to maintain a constant optical path length between document 16 and photoconductor 24. At the end of the forward scanning stroke, scanning carriages 28 and 36 are moved in the reverse direction to their original positions in preparation for another scanning cycle.

The operation of the scanning system 18 for reproduction ratios other than one-to-one is generally similar except that the full-rate and half-rate carriages are moved at velocities equal respectively to Vp/m and Vp/2m, where Vp is the peripheral velocity of the photoconductor drum 20 and m is the selected magnification. Further, if the copy length remains the same, the scanning length is changed to L/m, where L is the scanning length for a one-to-one reproduction ratio. Thus, for a 1.5:1 reproduction ratio (m=1.5), carriages 28 and 36 are driven at two-thirds and one-third the peripheral drum velocity, respectively, and are moved through displacements respectively equal to two-thirds and one-third the desired image length. Although the system for controlling the movement of carriages 28 and 36 does not as such form part of the present invention, a more detailed description of the scanning system 18 may be found in the copending application of applicant Benzion Landa et al, Ser. No. 628,239, filed July 6, 1984, entitled "Optical Scanning System for Variable-Magnification Copier".

In general, the object distance p between the lens 42 and the original document 16 and the image distance q between the lens and the imaging surface 24 are related by the equation $$1/p+1/q=1/f, \tag{1}$$

where f is the focal length of the lens 42. Since the image magnification m is given by the equation $$m=q/p, \tag{2}$$

we may solve for p and q in terms of m and f, and obtain $$p=(1+1/m)f, \tag{3}$$

$$q=(m+1)f, \tag{4}$$

and $$p+q=(m+1)^2f/m. \tag{5}$$

From these relations, it follows that for a given reproduction ratio the lens 42 must be shifted from its position for one-to-one magnification by a distance $$q=(m-1)f. \tag{6}$$

The lens 42 is shifted to the right as viewed in FIG. 1 for enlargements and to the left for reductions. Further, to obtain the proper total path length p+q for a given magnification, the half-rate carriage 36 must be shifted to the right, relative to full rate carriage 28, by a distance $$y=(m-1)^2f/2m. \tag{7}$$

The required shifting of half-rate carriage 36 is accomplished in the manner disclosed in the copending application of applicant Benzion Landa et al referred to above, Ser. No. 628,239, filed July 6, 1984.

Figure 2:
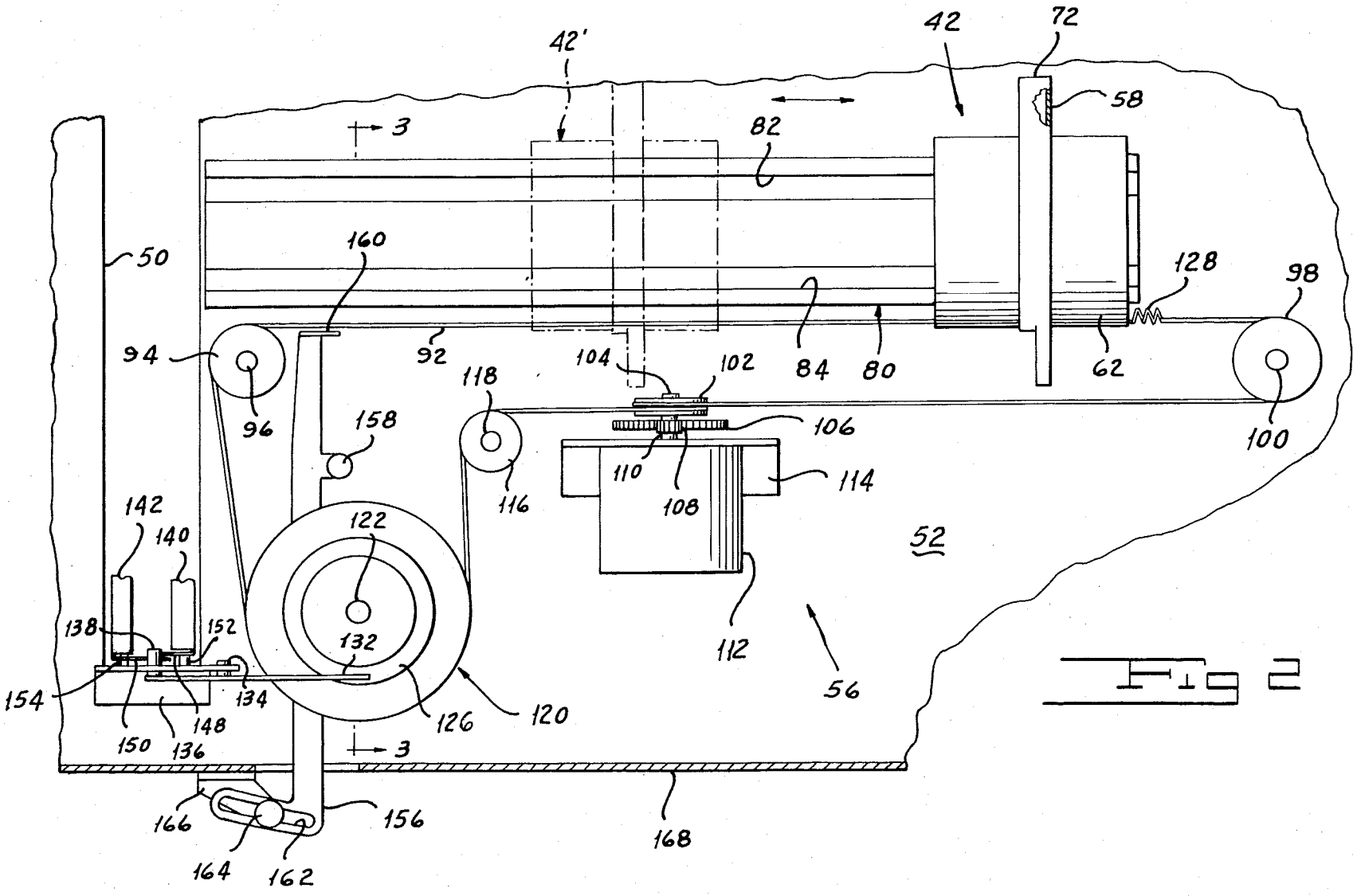
FIG. 2 is an enlarged fragmentary top plan, with parts broken away or shown in section, of the lens and shutter positioning mechanism of the copier shown in FIG. 1.
Figure 3:
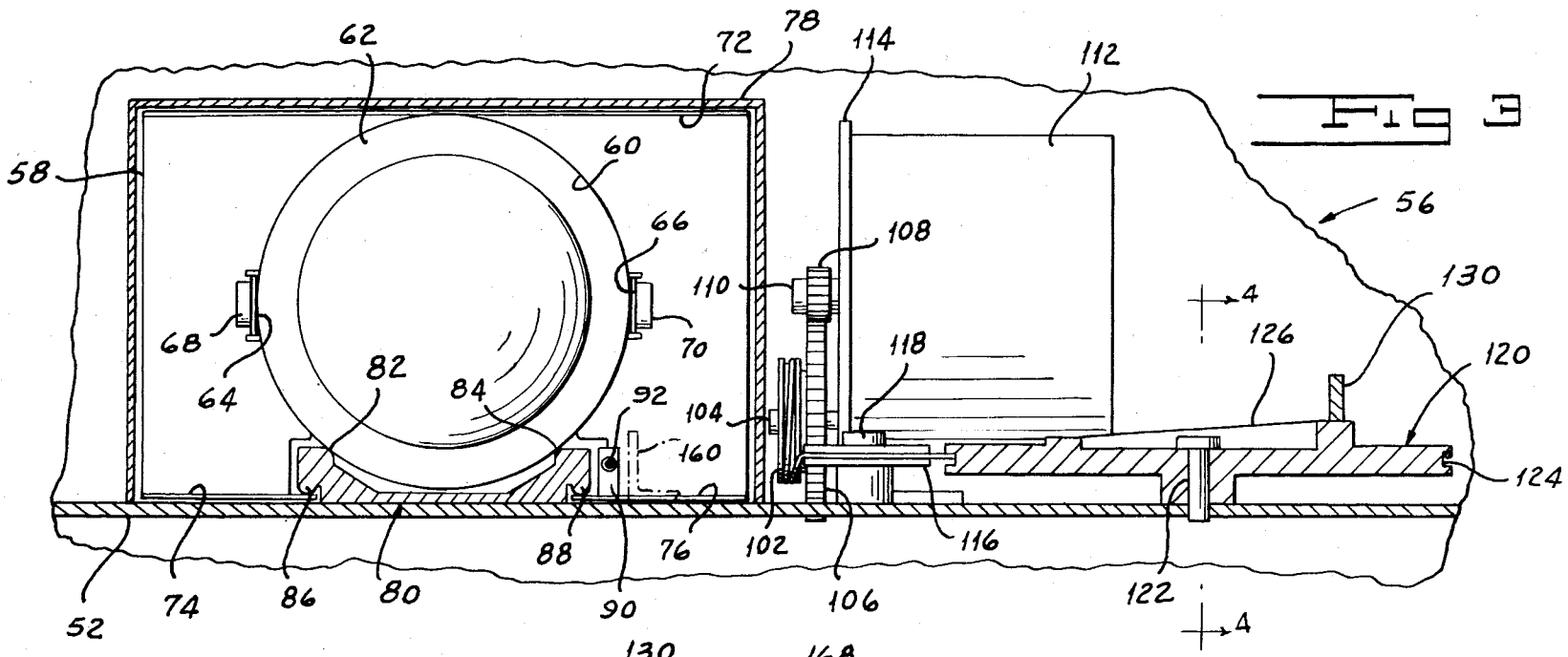
FIG. 3 is an enlarged fragmentary section of the lens and shutter positioning mechanism shown in FIG. 2, along line 3—3 thereof.
Figure 4:
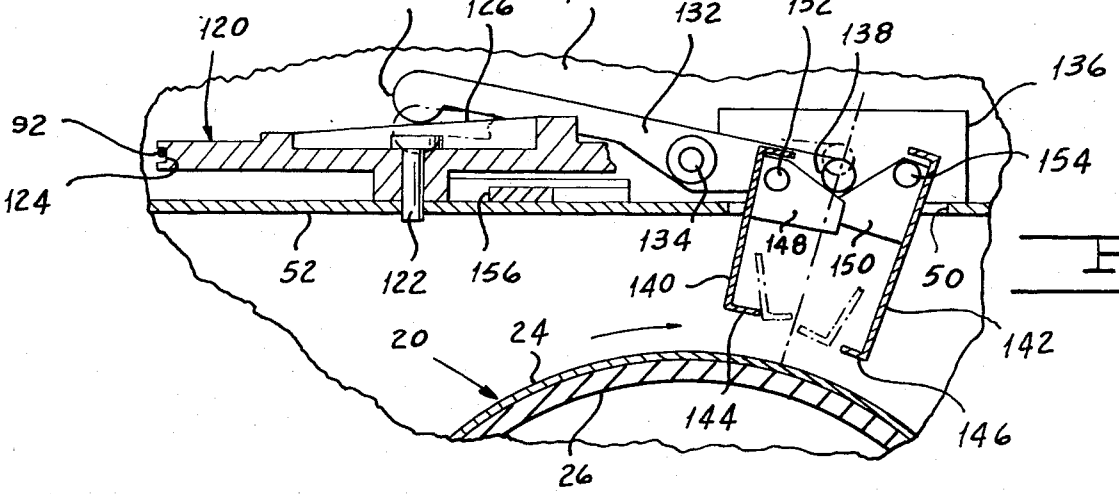
FIG. 4 is an enlarged fragmentary section of the lens and shutter positioning mechanism shown in FIG. 2, along line 4—4 of FIG. 3.

Referring now to FIGS. 2 to 4, the lens and shutter positioning mechanism, indicated generally by the reference numeral 56, includes a rectangular lens holder 58 extending generally transversely of the lens axis and formed with a circular opening 60 for receiving the barrel 62 of the lens 42. Respective screws 68 and 70 secure the lens barrel 62 to lugs 64 and 66 of lens holder 58. Referring now particularly to FIG. 3, lens holder 58 is formed with an upper lip 72 and rear and front lower lips 74 and 76 to ensure smoothness of movement along a guideway defined by a housing 78 (not shown in FIG. 2) and the partition 52. A track indicated generally by the reference numeral 80, secured to the partition 52, supports lens 42 for sliding movement along the optical axis b. As shown in FIG. 3, track 80 is formed with transversely spaced, longitudinally extending rounded edge portions 82 and 84, along which lens barrel 62 slides, as well as with longitudinally extending lower edges 86 and 88 against which lower lips 74 and 76 bear to maintain the lens 42 on the track 80.

A clamp 90 carried by lens holder 58 receives one end of a cord 92 which is tensioned in a manner to be described to move the lens 42 along the track 80. Cord 92 passes around a first pulley 94, located at the end of track 80 adjacent the exposure slit 50, and rotatably received by a shaft 96 carried by partition 52. From pulley 94, cord 92 passes around a relatively large-diameter pulley, indicated generally by the reference numeral 120, to be described in more detail below. From pulley 120, cord 92 successively passes around a pulley 116 rotating on a shaft 118 carried by partition 52, wraps once around a drive pulley 102, passes around an end pulley 98 supported by a shaft carried by partition 52, at the opposite end of track 80 from pulley 94, and returns to clamp 90 of lens holder 58, to which it is attached through a tension spring 128. A bi-directional stepper motor 112, supported on a bracket 114 carried by partition 52, drives pulley 102. The shaft 110 of stepper motor 112 carries a gear 108 which meshes with a gear 106 carried by the shaft 104 supporting pulley 102.

A pin 122 carried by partition 52 supports pulley 120 for rotation about a vertical axis. A peripheral groove 124 of pulley 120 receives cable 92, which extends around an approximately semi-circular portion of pulley 120. If desired, to prevent slippage between cable 92 and pulley 120, cable 92 may wrap around the pulley one or more times or may be secured to the pulley 120 at a predetermined point along its periphery. Pulley 120 is formed on its upper face with an annular incline or cam surface 126, the height of which varies angularly about the pulley 120 in a manner to be described.

Referring now also to FIG. 4, a pair of shutter elements 140 and 142 extending radially of the axis of the drum 20 have lower portions 144 and 146 extending circumferentially of the drum surface 24, which regulate the width of the optical image formed on the drum surface. Shutter elements 140 and 142 carry respective lugs 148 and 150 which are rotatably supported by pins 152 and 154 carried by a bracket 136 supported by partition 52 at one end of slot 50. A corresponding bracket (not shown) pivotally supports similar lugs (not shown) formed at the ends of shutter elements 140 and 142 adjacent to the rear of the copier 10. The bracket 136 at the front of the copier 10 also carries a pin 134 pivotally supporting an arm 132 formed with a follower 130 engaging the cam surface 126 of pulley 120. A pin 138 carried by follower arm 132 at the end remote from follower 130 bears against lugs 148 and 150 of shutter elements 140 and 142. Any suitable means (not shown) may be used, if desired, to assist gravity in resiliently biasing follower 130 against cam surface 126, as well as to bias lugs 148 and 150 against pin 138.

It will be apparent from the foregoing description that in response to rotation of pulley 120 upon actuation of motor 112 to vary the position of lens 42, pin 138 bears against lugs 148 and 150 to move slit-forming portions 144 and 146 either toward or away from each other, depending on the direction of rotation of pulley 120. It will be further apparent that the angle subtended by the adjacent edges of slit-forming portions 144 and 146, relative to the axis of the drum 20, determines the effective circumferential extent of the exposure station E, and hence the duration of exposure of any one point on the surface 24 of drum 20 to an optical image of the original 16. Accordingly, the cam surface 126 is so calibrated as to provide an exposure window to the drum 20, the angular width of which varies directly with the square of the distance along the optical path between the lens 42 and the drum surface 24. In such a manner, the exposure of the drum surface 24 to an optical image of the original 16 can be corrected for variations in image intensity over a wide range of selected magnifications, such as between 0.5 and 1.56.

The use of pulley 120, with its axially projecting cam surface 126, allows the use of a very simple linkage between the lens 42 and the shutter elements 140 and 142. As shown in FIG. 2, the cable system for regulating the position of the lens 42 is most advantageously disposed within a single horizontal plane. On the other hand, the movement of the shutter elements adjacent to the surface 24 of drum 20 occurs in a vertical plane, parallel to the front or back of the copier 10. Pulley 120, with its cam surface 126, effectively converts motion of the cable 92 in the horizontal plane to motion of the follower arm 132 in a longitudinal vertical plane, without any complicated linkage.

Referring to FIGS. 2 to 4, we provide an adjustable abutment or limit stop 160 defining a limit position of lens 42 at one end of the track 80, in this case the end adjacent to the slot 50. Limit stop 160 is formed at one end of an adjustment arm 156 carried by a pivot 158 secured to partition 52. A portion of arm 156 extending outwardly through a slot formed in a frame portion 168 of the copier 10 is formed with a slot 162 extending circumferentially with respect to the axis defined by pivot 158. A screw 164 extending through slot 162 and threadably received by a bracket 66 carried by frame portion 168 is normally tightened against arm 156 and bracket 166 to immobilize the arm 156 against rotation. Screw 164 may be loosened by a serviceman, however, to adjust the position of abutment 160 relative to track 80.

Figure 5:
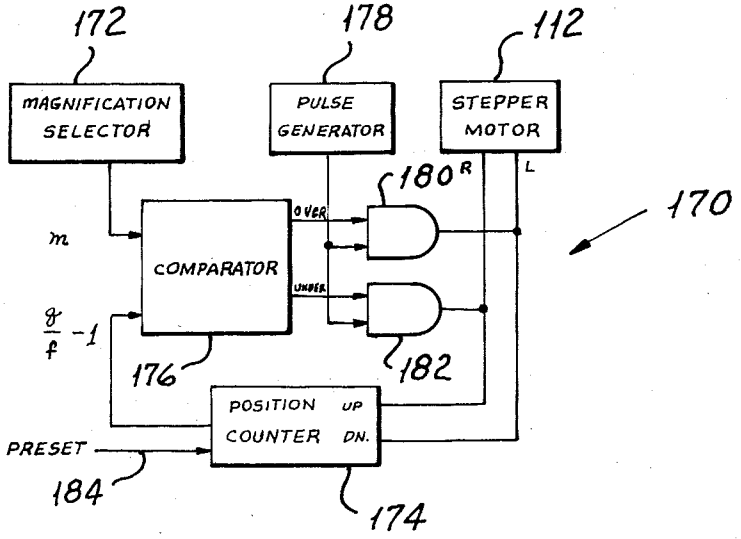
FIG. 5 is a schematic diagram of the control circuit for the lens and shutter positioning mechanism shown in FIG. 2.

Referring now to FIG. 5, the control circuit for regulating the position of lens 42 and shutter elements 140 and 142 is indicated generally by the reference numeral 170. The circuit 170 includes a magnification selector 172 of any suitable type known in the art for providing a multiple-channel digital signal, shown as being on a single line in FIG. 5 for convenience of exposition, indicating the selected magnification m. A presettable up-down counter 174 stores the current position of the lens 42 along the track 80. The scale factor and offset of the lens position as indicated by counter 174 are such that when the lens 42 is at the proper position for a selected magnification m, the output of counter 174 is equal to the se1=cted magnification. A digital comparator 176 responsive to the outputs of magnification selector 172 and counter 174 provides respective outputs to AND gates 180 and 182 indicating a lens position to the right or to the left of the proper position for the selected magnification m as viewed in FIG. 2. Each of AND gates 180 and 182 also receives an input from a pulse generator 178. AND gate 180 drives the down input of counter 174 as well as one input to stepper motor 112. Likewise, AND gate 182 drives the up input to up-down counter 174, as well as the other input to stepper motor 112.

If lens 42 is to the left of the proper position for the selected magnification ratio m, as viewed in FIG. 2, comparator 176 supplies a signal to AND gate 182, causing that gate to supply a pulse input to one directional input of stepper motor 112, as well as to the up input of position counter 174. This pulse output from AND gate 182 drives stepper motor 112 in such a direction as to move lens 2 to the right as viewed in FIG. 2. At the same time, the pulse output from AND gate 182 increments the position count contained in counter 174. When the position count reaches a value corresponding to the selected magnification m, comparator 176 will terminate the input to gate 182, thereby terminating the pulse train to stepper motor 112 and position counter 174. Lens 42 is thus moved to the proper position for the selected magnification, which position is stored in counter 174. The operation of circuit 170 to move lens 42 to the left as viewed in FIG. 2 is similar, except that the down input of position counter 174 and the left directional input of stepper motor 112 are actuated by pulses from AND gate 180. To correct the position of lens 42 for slippage between cable 92 and motor pulley 102, magnification selector 172 may be periodically actuated so as to provide a selected magnification signal m sufficiently low (less than 0.5) to drive lens holder 58 against abutment 160, inducing slippage between the cable 92 and motor pulley 102. Thereafter, position counter 174 may be preset, by way of an input on a preset line 184, to a count corresponding to the nominal position of the stop 160.

It will be seen that we have accomplished the objects of our invention. Our lens and shutter positioning mechanism, while being simple and inexpensive, provides accurate exposure compensation for variations in image brightness over a wide range of selected magnifications.

It will be understood that certain features and subcombinations are of utility and may be employed without reference to other features and subconbinations. This is contemplated by and is within the scope of our claims. It is further obvious that various changes may be made in details within the scope of our claims without departing from the spirit of our inventnon. It is, therefore, to be understood that our invention is not to be limited to the specific details shown and described.

Having thus described our invention, what we claim is:

1. Apparatus including in combination means forming an optical slit, a photosensitive member adapted to move past said slit, means including a movable optical element for forming an optical image of an original on said member, means for moving said optical element to a position corresponding to a desired magnification selected from a substantially continuous range, a cam, a follower having a region of contact with said cam, said cam being mounted for movement in a predetermined direction at said region of contact, said follower being mounted for movement into contact with said cam in a direction generally normal to said predetermined direction at said region of contact, said cam being so shaped that the displacement of said region of contact in said normal direction varies with the displacement of said cam in said predetermined direction, whereby movement of said cam in said predetermined direction produces a movement of said follower in said normal direction, means responsive to movement of said optical element for producing a proportional movement of said cam in said predetermined direction, and means controlled by said follower for adjusting the width of said slit.

2. Apparatus as in claim 1 in which the brightness of said optical image varies with the selected magnification, the variation in the displacement of said region of contact in said normal direction with the displacement of said cam in said predetermined direction being such as to correct the exposure of said photosensitive member for variations in the brightness of said image over the entirety of said range of magnifications.

3. Apparatus as in claim 1 in which said range magnifications extends from approximately 0.5 to 1.5.

4. Apparatus as in claim 1 in which said photosensitive member comprises a photoconductor.

5. Apparatus as in claim 1 in which said optical element comprises a lens.

6. Apparatus as in claim 1 in which said cam is mounted for rotation on an axis and is so shaped that the axial displacement of said region of contact varies with the rotation of said cam.

7. Apparatus including in combination a photosensitive member, means including a movable optical element for forming an optical image of an original on said member, means for regulating the exposure of said member to said image, a pulley having a cam surface, a flexible member coupled to said optical element and said pulley, a follower engaging said cam surface, means for coupling said follower to said regulating means, and means for rotating said pulley to move said optical element and concomitantly adjust the exposure of said photosensitive member to said image.

8. Apparatus as in claim 7 in which said regulating means comprises means for forming an optical slit limiting the size of said image.

9. Apparatus including in combination a photosensitive member, means including a movable optical element for forming an optical image of an original on said member, means for regulating the exposure of said member to said image, a cam mounted for rotation on an axis, means for coupling said cam to said optical element for proportional rotation of said cam and movement of said element, a follower mounted for generally axial movement into contact with said cam, means for coupling said follower to said regulating means, and means for rotating said cam to move said optical element and concomitantly adjust the exposure of said member to said image.

10. Apparatus as in claim 9 in which said regulating means comprises means for forming an optical slit limiting the size of said image.

* * * * *